US008307660B2

(12) United States Patent
Stewart et al.

(10) Patent No.: US 8,307,660 B2
(45) Date of Patent: Nov. 13, 2012

(54) COMBUSTOR NOZZLE AND METHOD FOR SUPPLYING FUEL TO A COMBUSTOR

(75) Inventors: Jason Thurman Stewart, Greer, SC (US); Thomas Edward Johnson, Greer, SC (US)

(73) Assignee: General Electric Company, Schenectady, NY (US)

( * ) Notice: Subject to any disclaimer, the term of this patent is extended or adjusted under 35 U.S.C. 154(b) by 22 days.

(21) Appl. No.: 13/083,769

(22) Filed: Apr. 11, 2011

(65) Prior Publication Data

US 2012/0255310 A1 Oct. 11, 2012

(51) Int. Cl.
*F02C 1/00* (2006.01)

(52) U.S. Cl. ..... 60/772; 60/748

(58) Field of Classification Search ..... 60/39.23, 60/737, 740, 742, 748; 239/399, 403, 509, 239/590.5

See application file for complete search history.

(56) References Cited

U.S. PATENT DOCUMENTS

| | | | | |
|---|---|---|---|---|
| 5,207,558 | A | 5/1993 | Hagle et al. | |
| 6,993,916 | B2 * | 2/2006 | Johnson et al. | 60/776 |
| 7,322,791 | B2 | 1/2008 | Stilgenbauer | |
| 7,458,764 | B2 | 12/2008 | Lombard et al. | |
| 8,024,932 | B1 * | 9/2011 | Stewart | 60/748 |
| 2011/0005189 | A1 * | 1/2011 | Uhm et al. | 60/39.281 |

* cited by examiner

*Primary Examiner* — Phutthiwat Wongwian

(74) *Attorney, Agent, or Firm* — Dority & Manning, P.A.

(57) ABSTRACT

A combustor nozzle includes a center body and a shroud circumferentially surrounding at least a portion of the center body to define a passage between the center body and the shroud. A guide between the center body and the shroud can pivot with respect to the center body. A method for supplying fuel to a combustor includes flowing a working fluid through a nozzle at a mass flow rate and flowing a fuel through the nozzle. The method further includes sensing a flame holding event inside the nozzle and pivoting a guide inside the nozzle to increase the mass flow rate of the working fluid flowing through the nozzle.

20 Claims, 9 Drawing Sheets

COMBUSTOR NOZZLE AND METHOD FOR SUPPLYING FUEL TO A COMBUSTOR

FIELD OF THE INVENTION

The present invention generally involves a combustor nozzle. In particular, the present invention describes and enables a nozzle for a combustor and a method for responding to a flame holding event in the combustor nozzle.

BACKGROUND OF THE INVENTION

Combustors are commonly used in many forms of commercial equipment. For example, gas turbines typically include one or more combustors that mix fuel with a working fluid to generate combustion gases having a high temperature and pressure. Many combustors include nozzles that premix the fuel with the working fluid prior to combustion. Premixing the fuel with the working fluid prior to combustion allows for leaner fuel mixtures, reduces undesirable emissions, and/or improves the overall thermodynamic efficiency of the gas turbine.

During normal combustor operations, a combustion flame exists downstream from the nozzles, typically in a combustion chamber at the exit of the nozzles. Occasionally, however, an event referred to as "flame holding" occurs in which a combustion flame exists upstream of the combustion chamber inside one or more nozzles. For example, conditions may exist in which a combustion flame exists near a fuel port in the nozzles or near an area of low flow in the nozzles. Nozzles are typically not designed to withstand the high temperatures created by a flame holding event, and flame holding may therefore cause severe damage to a nozzle in a relatively short amount of time.

Various methods are known in the art for preventing or reducing the occurrence of flame holding. For example, flame holding is more likely to occur during the use of higher reactivity fuels or during the use of higher fuel-to-working-fluid ratios. Flame holding is also more likely to occur during operations in which the fuel-working fluid mixture flows through the nozzles at lower velocities. Combustors may therefore be designed with specific safety margins for fuel reactivity, fuel-to-working-fluid ratios, and/or fuel-working fluid mixture velocity to prevent or reduce the occurrence of flame holding. While the safety margins are effective at preventing or reducing the occurrence of flame holding, they may also result in reduced operating limits, additional maintenance, reduced operating lifetimes, and/or reduced overall thermodynamic efficiency. Therefore, a combustor nozzle and/or method for supplying fuel to the combustor in response to a flame holding event would be desirable.

BRIEF DESCRIPTION OF THE INVENTION

Aspects and advantages of the invention are set forth below in the following description, or may be obvious from the description, or may be learned through practice of the invention.

One embodiment of the present invention is a combustor nozzle that includes a center body and a shroud circumferentially surrounding at least a portion of the center body to define a passage between the center body and the shroud. A guide between the center body and the shroud can pivot with respect to the center body.

Another embodiment of the present invention is a combustor nozzle that includes a center body having a thermal coefficient of expansion. A plate extends inside at least a portion of the center body. A guide is connected to the center body and the plate so that the guide can pivot with respect to the center body.

The present invention also includes a method for supplying fuel to a combustor. The method includes flowing a working fluid through a nozzle at a mass flow rate and flowing a fuel through the nozzle. The method further includes sensing a flame holding event inside the nozzle and pivoting a guide inside the nozzle to increase the mass flow rate of the working fluid flowing through the nozzle.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying Figures, in which.

DETAILED DESCRIPTION OF THE INVENTION

Figure 1:
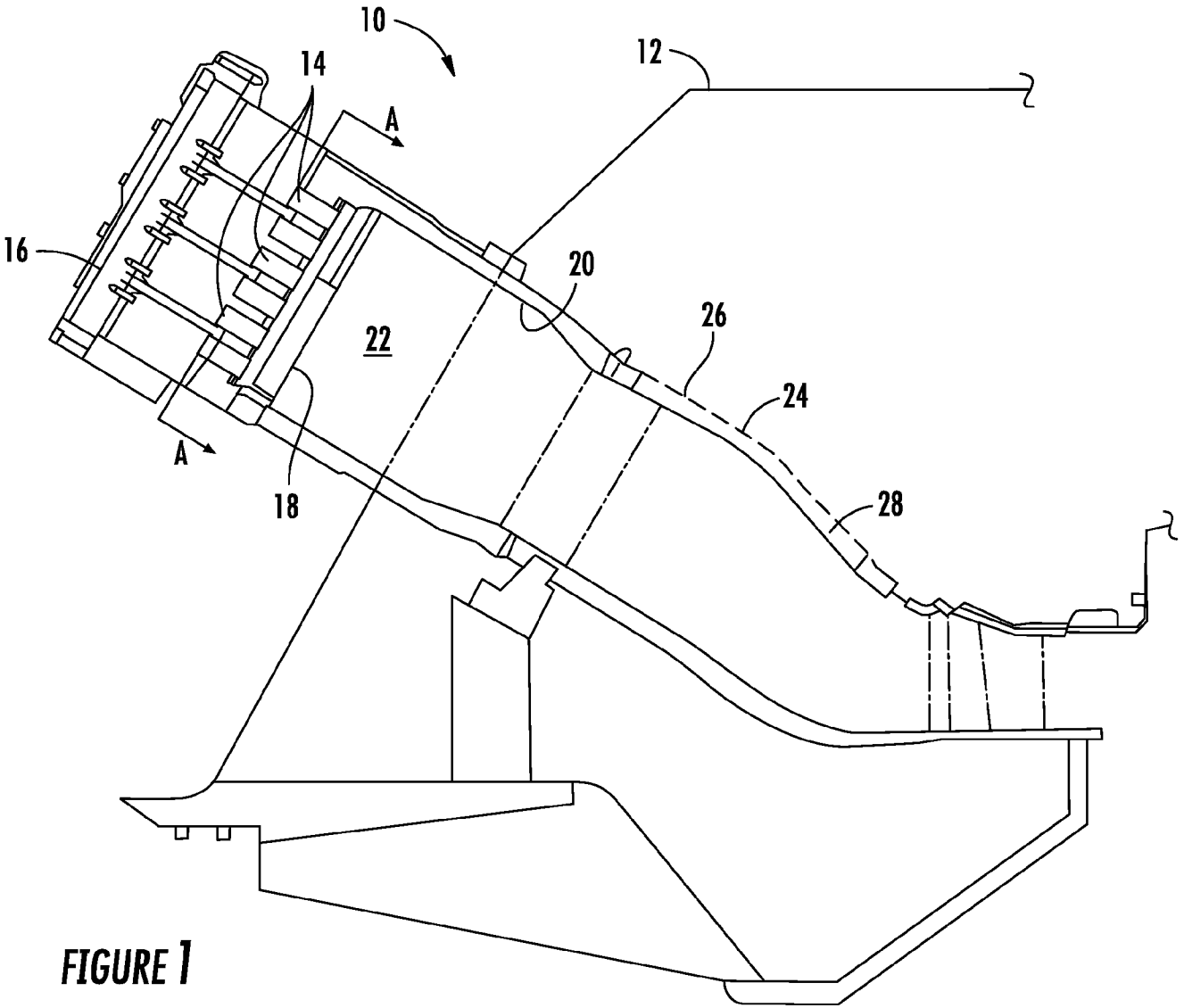
FIG. 1 is a simplified cross-section of a combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include an active device that minimizes or prevents damage to a nozzle or combustor caused by flame holding. When flame holding occurs, the active device reduces the swirling of fuel and working fluid flowing through the nozzle. The reduced swirling of fuel and working fluid in the nozzle in which flame holding is occurring allows that nozzle to "borrow" additional working fluid from adjacent nozzles, thus increasing the axial velocity and/or mass flow rate of the fuel and working fluid mixture to effectively push the combustion flame out of the nozzle. In addition, assuming a constant fuel mass flow rate, the increased mass flow rate of the working fluid reduces the ratio of fuel-to-working-fluid in the nozzle. The reduced fuel-to-working-fluid ratio further aids to extinguish or remove the combustion flame from the nozzle. When flame holding no longer exists, the active device returns to its previous position to impart swirling to or allow swirling of the fuel and working fluid flowing through the nozzle.

By responding to flame holding, the active device may provide an increase in margins before the onset of flame holding or allow for less restrictive operating limits during normal operations. For example, the ability of the active device to respond to flame holding may allow for the use of fuels with higher reactivity, less restrictive design limitations on the location of fuel injection, and fewer forced outages caused by flame holding. As a further example, the active device may allow for reduced nozzle velocities during normal operations, resulting in reduced pressure losses across the nozzle and increased thermodynamic efficiency.

FIG. 1 shows a simplified cross-section view of a combustor 10 according to one embodiment of the present invention. A casing 12 may surround the combustor 10 to contain the air or working fluid flowing to the combustor 10. As shown, the combustor 10 may include one or more nozzles 14 radially arranged in an end cover 16, and a top cap 18 and a liner 20 may generally define or surround a combustion chamber 22 located downstream of the nozzles 14. As used herein, the terms "upstream" and "downstream" refer to the relative location of components in a fluid pathway. For example, component A is upstream of component B if a fluid flows from component A to component B. Conversely, component B is downstream of component A if component B receives a fluid flow from component A. A flow sleeve 24 with flow holes 26 may surround the liner 20 to define an annular passage 28 between the flow sleeve 24 and the liner 20. The air or working fluid may pass through the flow holes 26 in the flow sleeve 24 to flow along the outside of the liner 20 to provide impingement or convective cooling to the liner 20. The air or working fluid then reverses direction to flow through the one or more nozzles 14 where it mixes with fuel before igniting in the combustion chamber 22 to produce combustion gases having a high temperature.

Figure 2:
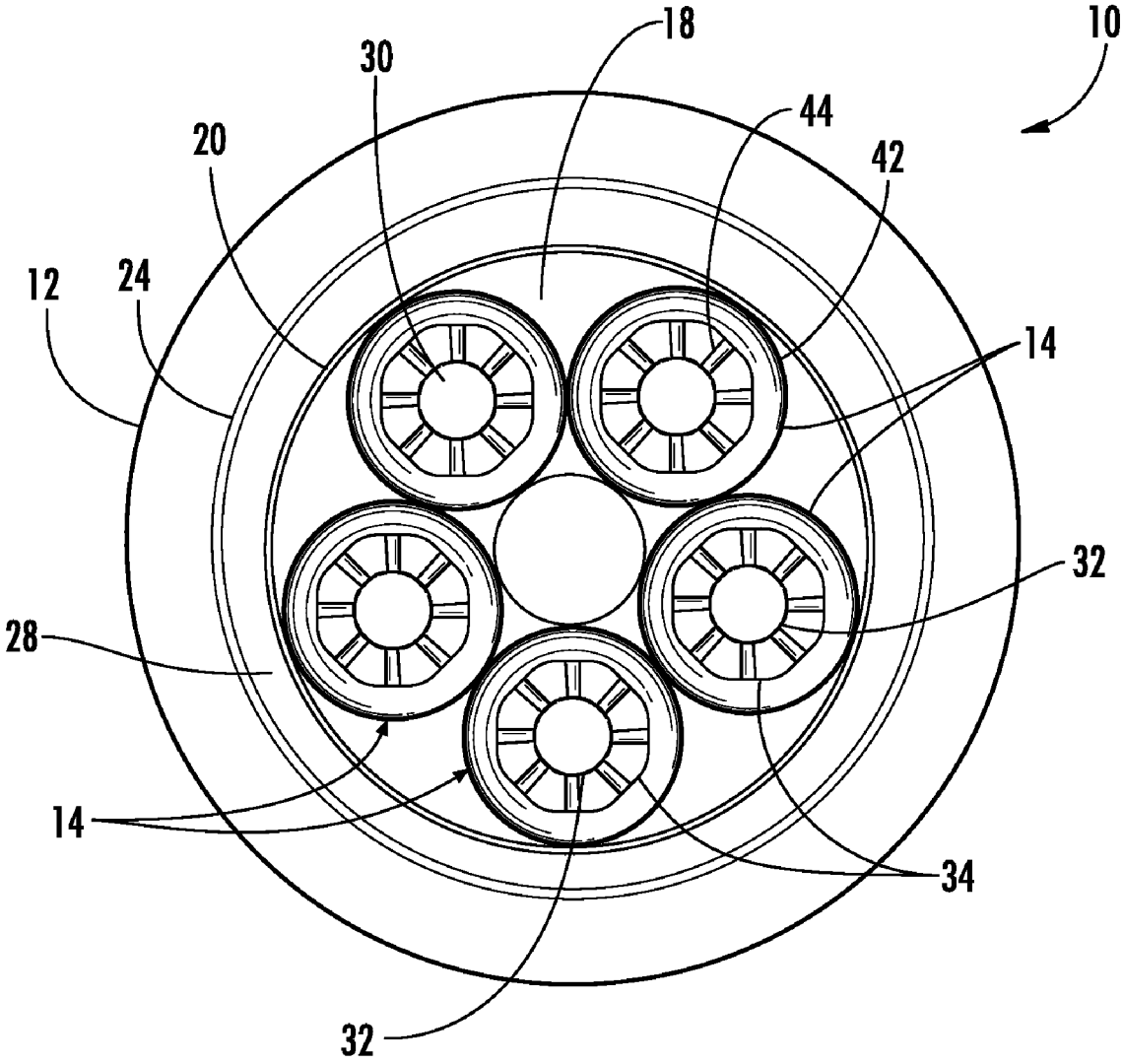
FIG. 2 is a downstream axial view of the combustor shown in FIG. 1 taken along line A-A.

FIG. 2 provides downstream axial view of the combustor 10 shown in FIG. 1 taken along line A-A. Various embodiments of the combustor 10 may include different numbers and arrangements of nozzles. For example, in the embodiment shown in FIG. 2, the combustor 10 includes five nozzles 14 radially arranged in the top cap 18. The working fluid flows through the annular passage 28 between the flow sleeve 24 and the liner 20 (out of FIG. 2) until it reaches the volume between the end cover 16 and top cap 18 where it reverses direction to flow through the nozzles 14 (into FIG. 2) and into the combustion chamber 22.

Figure 3:
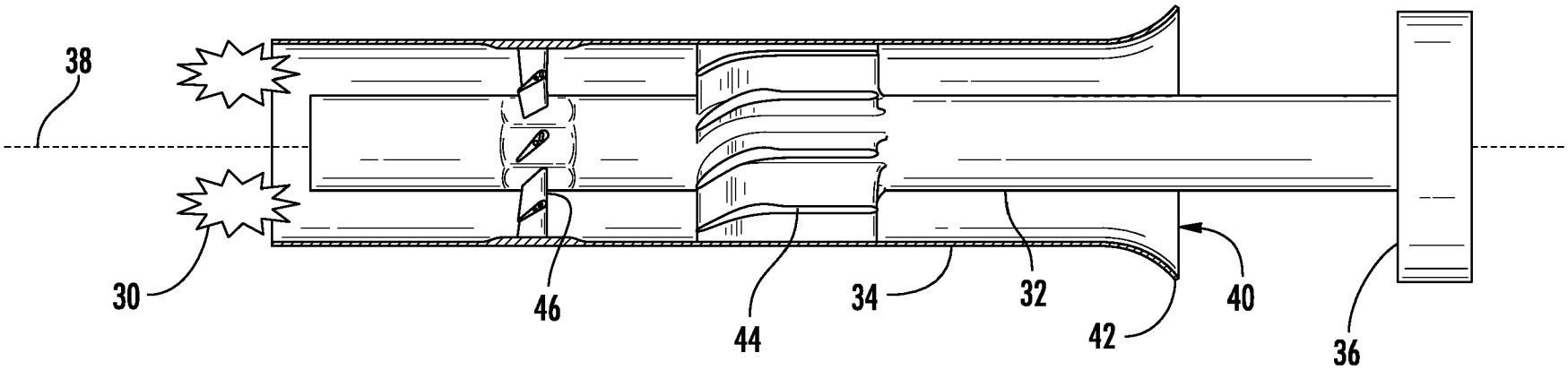
FIG. 3 is a side perspective view of a nozzle according to one embodiment of the present invention during normal operations.

FIG. 3 shows a side perspective view of the nozzle 14 according to one embodiment of the present invention during normal operations in which a combustion flame 30 exists downstream of the nozzle 14 in the combustion chamber 22. The nozzle 14 generally includes a center body 32 and a shroud 34, although alternate embodiments within the scope of the present invention may include a center body 32 without a shroud 34. The center body 32 may connect at one end to a nozzle flange 36 so that fuel may be supplied through the flange 36 to the center body 32. The center body 32 generally extends along an axial centerline 38 of the nozzle 14, and the shroud 34, if present, circumferentially surrounds at least a portion of the center body 32 to define a passage 40 between the center body 32 and the shroud 34. The shroud 34 may include a bellmouth opening 42 or other inlet guide to evenly distribute the working fluid entering the nozzle 14 and flowing through the passage 40. Fuel may be injected into the passage 40 directly from the center body 32 or from swirler vanes 44 extending radially between the center body 32 and the shroud 34. In this manner, the swirler vanes 44 may impart a tangential velocity to the fuel and working fluid to evenly mix the fuel and working fluid flowing through the passage 40 before the mixture reaches the combustion chamber 22.

As shown in FIG. 3, the nozzle 14 further includes one or more guides 46 between the center body 32 and the shroud 34 and connected to the center body 32 downstream from the swirler vanes 44. The guides 46 rotate or pivot with respect to the center body 32 and/or the shroud 34 in response to a flame holding event. Specifically, during normal operations when the combustion flame 30 exists downstream of the nozzle 14 in the combustion chamber 22, the guides 46 may be disposed or aligned in the passage 40 at an angle acute to the axial centerline 38 of the nozzle 14. In this alignment, the guides 46 may be generally aligned with the angle of the swirler vanes 44 so as to not disturb the tangential velocity of the fuel and working fluid mixture during normal operations. In contrast, during a flame holding event, the guides 46 rotate or pivot with respect to the center body 32 and/or shroud 34 so that the guides 46 may be generally aligned with the axial centerline 38 of the nozzle 14.

Figure 4:
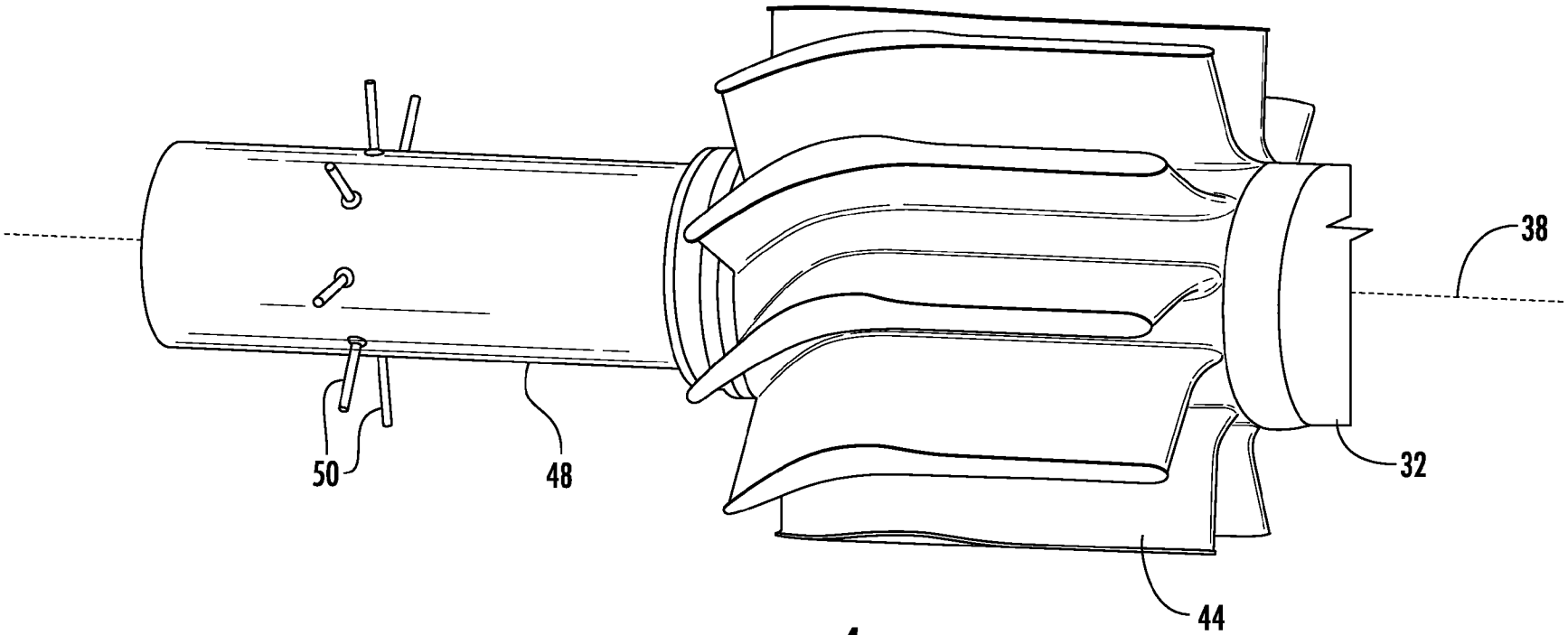
FIG. 4 is a partial perspective view of the nozzle shown in FIG. 3.

FIGS. 4-9 provide various partial perspective views and diagrams of the nozzle 14 shown in FIG. 3 to illustrate the structure and operation of the guides 46 in more detail. Specifically, FIG. 4 shows a partial perspective view of the nozzle 14 shown in FIG. 3 with the shroud 34, guides 46, and a portion of the center body 32 removed. As shown, the nozzle 14 may include a plate 48 and a first set of one or more pins, rods 50, or other suitable structures that extend radially from the plate 48. The plate 48 may comprise any suitable material capable of continuous exposure to the anticipated temperatures inside the nozzle 14. For example, the plate 48 may comprise a cylinder or a plurality of strips that extend axially inside at least a portion of the center body 32 adjacent to or proximate to an inner surface of the center body 32. In particular embodiments, the plate 48 may have a lower thermal coefficient of expansion than the center body 32. For example, the plate 48 may be forged, rolled, or machined from nickel steel alloys such as iron and nickel that have a lower thermal coefficient of expansion than the center body 32. The first set of rods 50 may be fixedly or rotatably connected to the plate 48 and extend radially from the plate 48 to connect the plate 48 to the guides 46.

Figure 5:
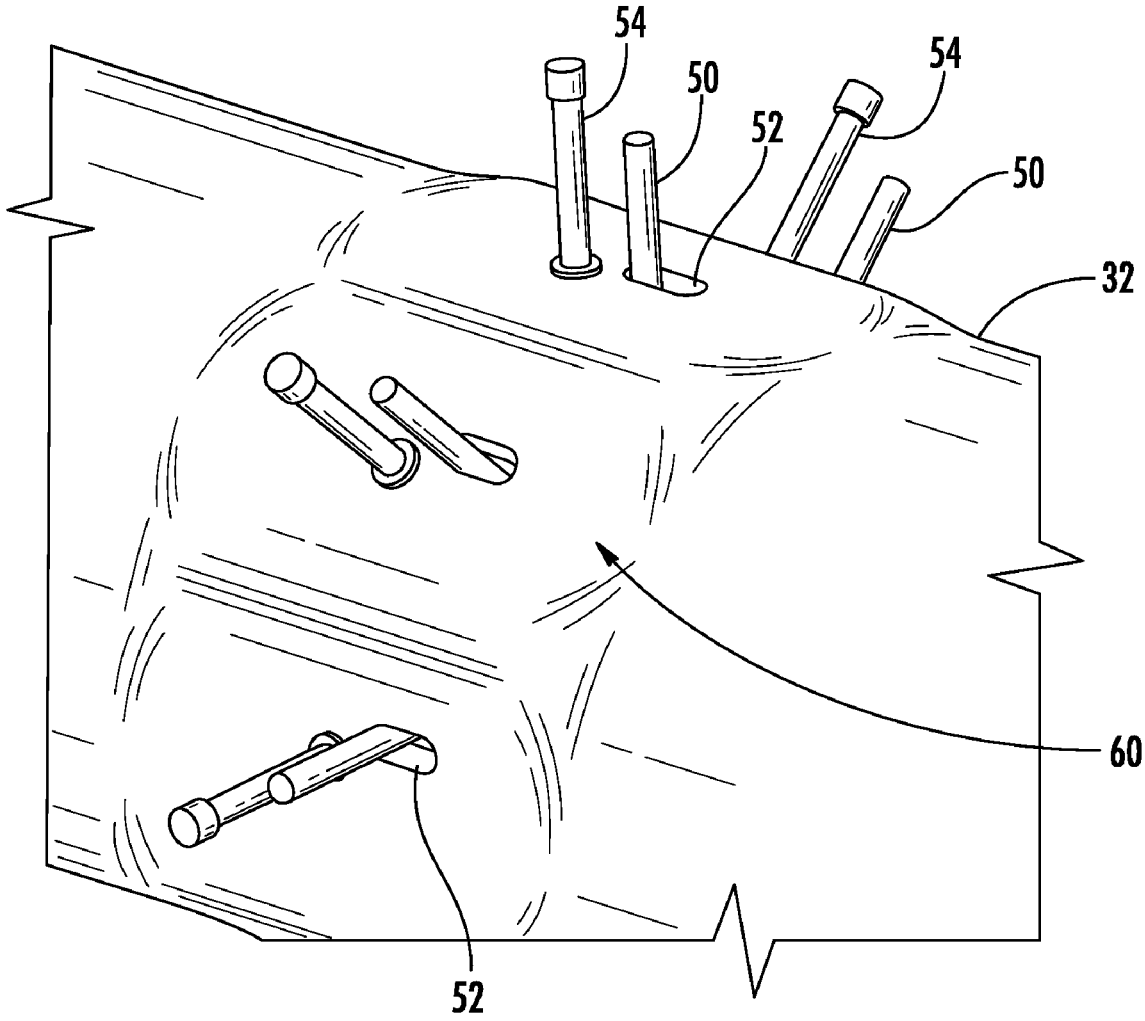
FIG. 5 is another partial perspective view of the nozzle shown in FIG. 3.

FIG. 5 shows another partial perspective view of the nozzle 14 shown in FIG. 3 with the center body 32 again covering the plate 48. As shown, the first set of rods 50 extend radially from the plate 48 through slots 52 in the center body 32. The slots 52 thus allow the center body 32 to move axially with respect to the plate 48 and the first set of rods 50. For example, during a flame holding event, the combustion flame 30 may exist inside the nozzle 14 in the passage 40 proximate to the swirler vanes 44 and/or the center body 32. The increased temperature associated with the combustion flame 30 proximate to the swirler vanes 44 and/or the center body 32 will increase the temperature of the center body 32 faster than and/or more than the underlying plate 48. If applicable, the larger thermal coefficient of expansion of the center body 32 compared to that of the plate 48 will also cause the center body to expand or extend axially more than the underlying plate 48. As a result, the slots 52 in the center body 32 will allow the center body 32 to extend axially with respect to the plate 48 and the first set of rods 50. As further shown in FIG. 5, a second set of one or more pins, rods 54, or other suitable structures may extend radially from the center body 32. The second set of rods 54 may be fixedly or rotatably connected to the center body 32 and extend radially from the center body 32 to connect the center body 32 to the guides 46.

Figure 6:
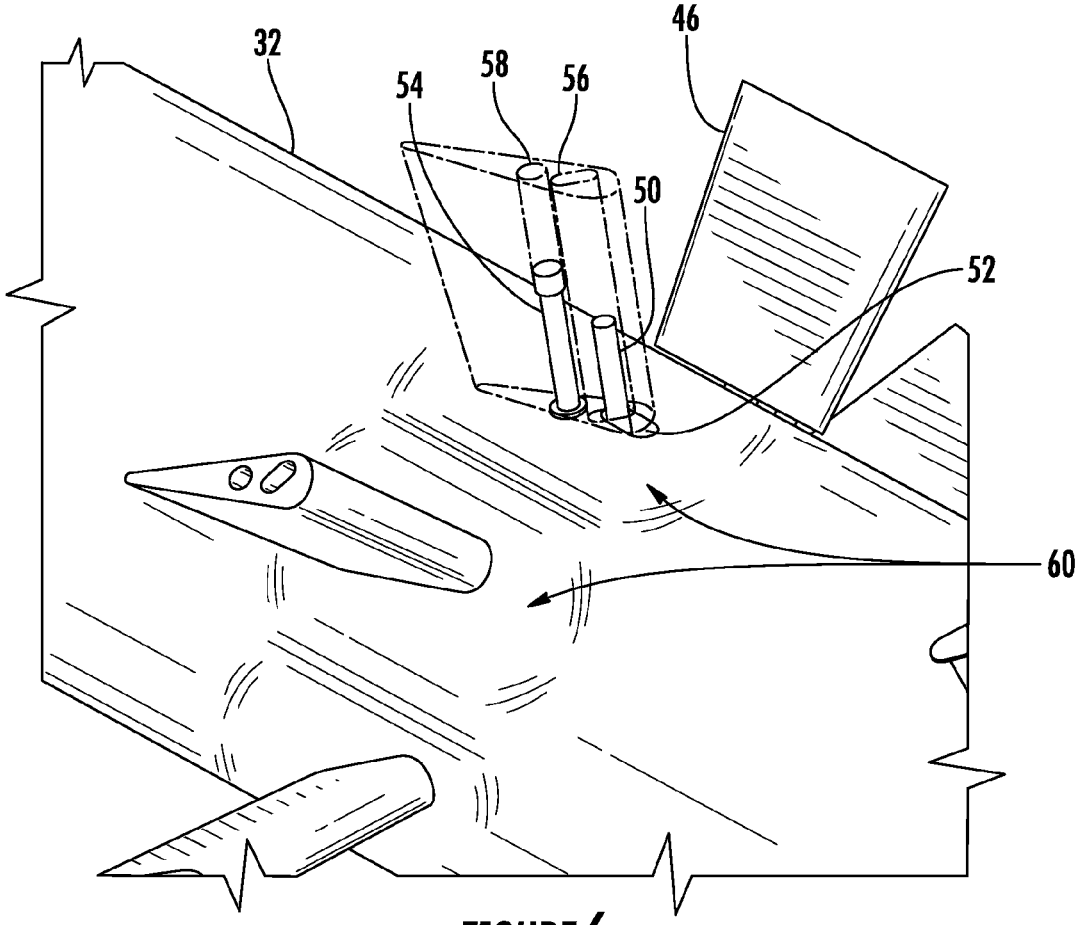
FIG. 6 is another partial perspective view of the nozzle shown in FIG. 3.
Figure 7:
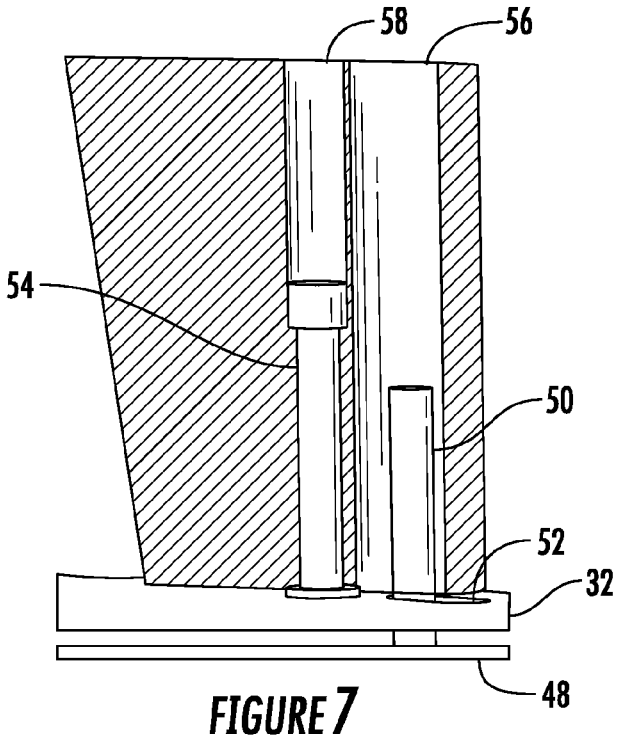
FIG. 7 is a side view of a guide shown in FIG. 3.

FIGS. 6 and 7 show another partial perspective view and side view, respectively, of the nozzle 14 shown in FIG. 3 with the center body 32 again covering the plate 48 and the guides 46 again installed over the first and second set of rods 50, 54. As shown, the guides 46 include a pair of recesses or hollow passages that allow the first and second rods 50, 54 to fit inside each guide 46. The recesses or hollow passages may extend radially through some or all of each guide 46. In this particular embodiment, the first set of rods 50 extend radially into a guide slot 56 that provides a sliding connection between the guide 46 and the plate 48 and/or the first set of rods 50. Similarly, the second set of rods 54 extend radially into a guide hole 58 that provides a pivotal connection between the guide 46 and the center body 32 and/or the second set of rods 54. Notably, as shown most clearly in FIGS. 5 and 6, and as will be explained in more detail with respect to FIGS. 11 and 12, the center body 32 may include a substantially flat portion 60 proximate to each guide 46. The substantially flat portion 60, if present, allows each guide 46 to rotate or pivot with respect to the center body 32 without binding or creating an excessive gap between the center body 32 and the guides 46 which might create an attachment point for the combustion flame 30.

Figure 8:
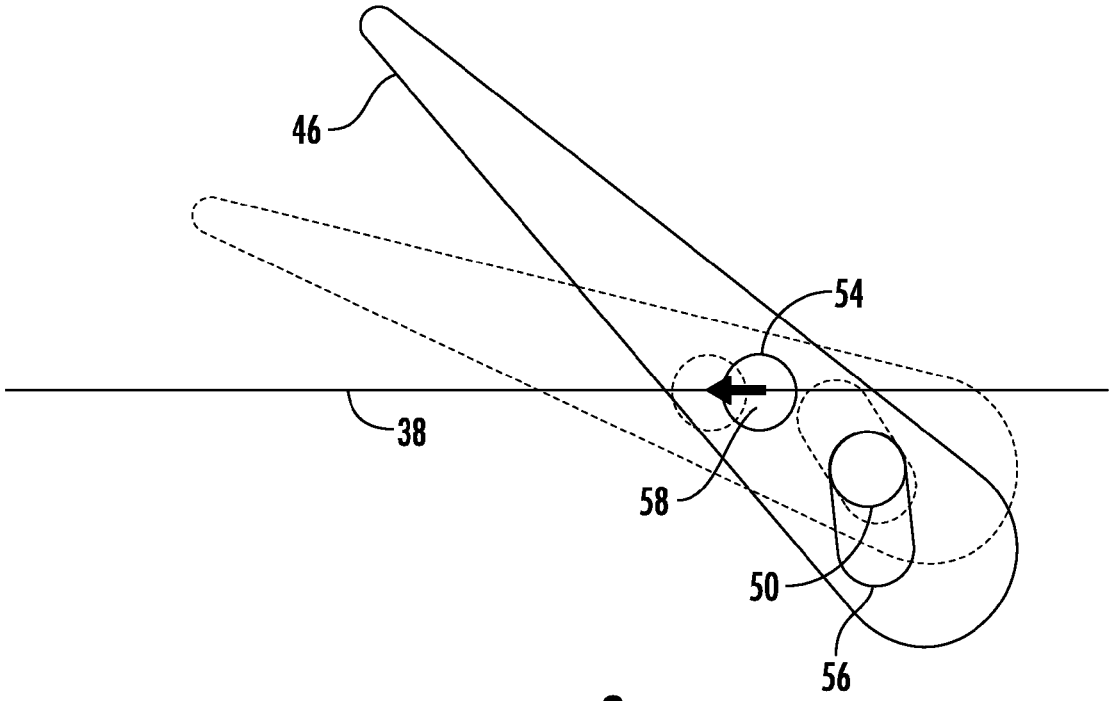
FIG. 8 is a diagram of the guide shown in FIG. 3 responding to a flame holding event.

FIG. 8 provides a diagram of the guide 46 shown in FIG. 3 responding to a flame holding event (shown in dashed lines). During normal operations in which the combustion flame 30 exists downstream of the nozzle 14 in the combustion chamber 22, the guides 46 may be disposed or aligned in the passage 40 at an angle acute to the axial centerline 38 of the nozzle 14. In this alignment, the guides 46 may be generally aligned with the angle of the swirler vanes 44 so as to not disturb the tangential velocity of the fuel and working fluid mixture during normal operations. During a flame holding event, the combustion flame 30 increases the temperature of the center body 32 faster and/or more than the underlying plate 48. If applicable, the larger thermal coefficient of expansion of the center body 32 compared to that of the plate 48 will also cause the center body 32 to expand or extend axially more than the underlying plate 48, causing the second set of rods 54 to move axially away from the first set of rods 50. The sliding connection between the guide 46 and the plate 48 or first set of rods 50 and the pivotal connection between the guide 46 and the center body 32 or second set of rods 54 causes the guide 46 to rotate or pivot with respect to the center body 32 and/or shroud 34. As a result of the rotation, the guide 46 becomes aligned with or more closely aligned with the axial centerline 38 of the nozzle 14, thus increasing the axial velocity and/or mass flow rate of the fuel and working fluid mixture to effectively push the combustion flame 30 out of the nozzle 14. In addition, assuming a constant fuel mass flow rate, the increased mass flow rate of the working fluid reduces the ratio of fuel-to-working-fluid in the nozzle 14. The reduced fuel-to-working-fluid ratio further aids to extinguish or remove the combustion flame 30 from the nozzle 14. When the flame holding event no longer exists, the center body 32 cools and retracts to return the guide 46 to the initial position at an angle acute to the axial centerline 38 of the nozzle 14.

Figure 9:
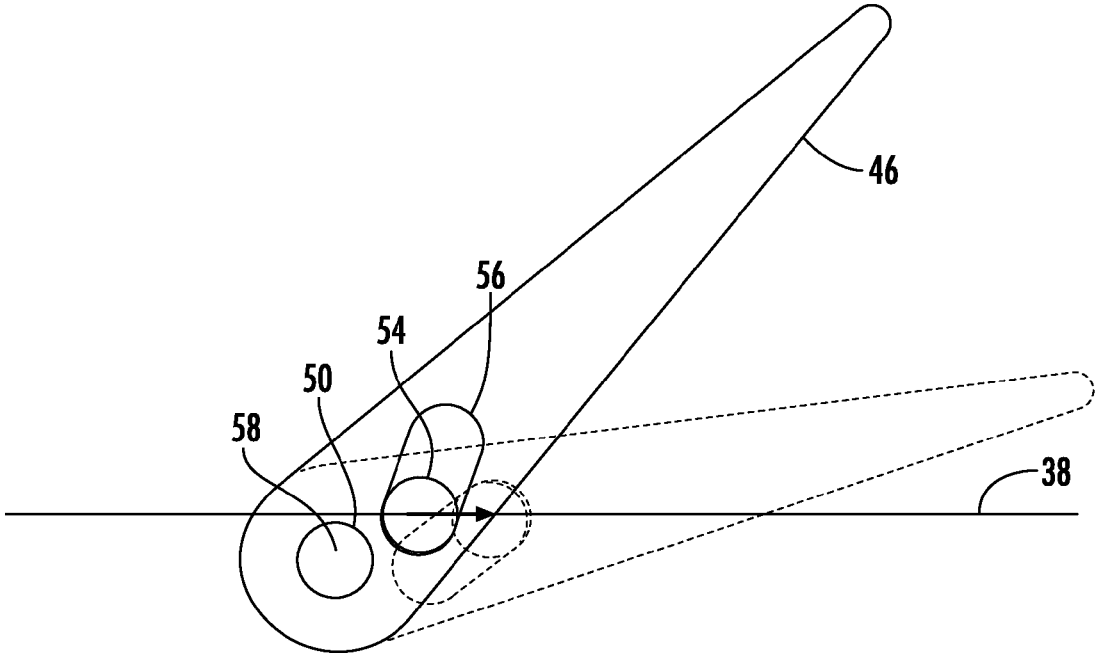
FIG. 9 is a diagram of an alternate embodiment of the guide shown in FIG. 3 responding to a flame holding event.

FIG. 9 provides a diagram of an alternate embodiment of the guide 46 shown in FIG. 3 responding to a flame holding event (shown in dashed lines). In this particular embodiment, the first set of rods 50 extend radially into the guide hole 58, and the second set of rods 54 extend radially into the guide slot 56. As a result, the guide hole 58 provides a pivotal connection between the guide 46 and the plate 48 and/or the first set of rods 50, and the guide slot 56 provides a sliding connection between the guide 46 and center body 32 and/or the second set of rods 50. During a flame holding event, the combustion flame 30 increases the temperature of the center body 32 faster and/or more than the underlying plate 48. If applicable, the larger thermal coefficient of expansion of the center body 32 compared to that of the plate 48 will also cause the center body 32 to expand or extend axially more than the underlying plate 48, causing the second set of rods 54 to move axially away from the first set of rods 50. The sliding connection between the guide 46 and the second set of rods 54 and the pivotal connection between the guide 46 and the first set of rods 50 causes the guide 46 to rotate or pivot with respect to the center body 32 and/or shroud 34. As a result of the rotation, the guide 46 becomes aligned with or more closely aligned with the axial centerline 38 of the nozzle 14, thus increasing the axial velocity and/or mass flow rate of the fuel and working fluid mixture to effectively push the combustion flame 30 out of the nozzle 14. In addition, assuming a constant fuel mass flow rate, the increased mass flow rate of the working fluid reduces the ratio of fuel-to-working-fluid in the nozzle 14. The reduced fuel-to-working-fluid ratio further aids to extinguish or remove the combustion flame 30 from the nozzle 14. When the flame holding event no longer exists, the center body 32 cools and retracts to return the guide 46 to the initial position at an angle acute to the axial centerline 38 of the nozzle 14.

Figure 10:
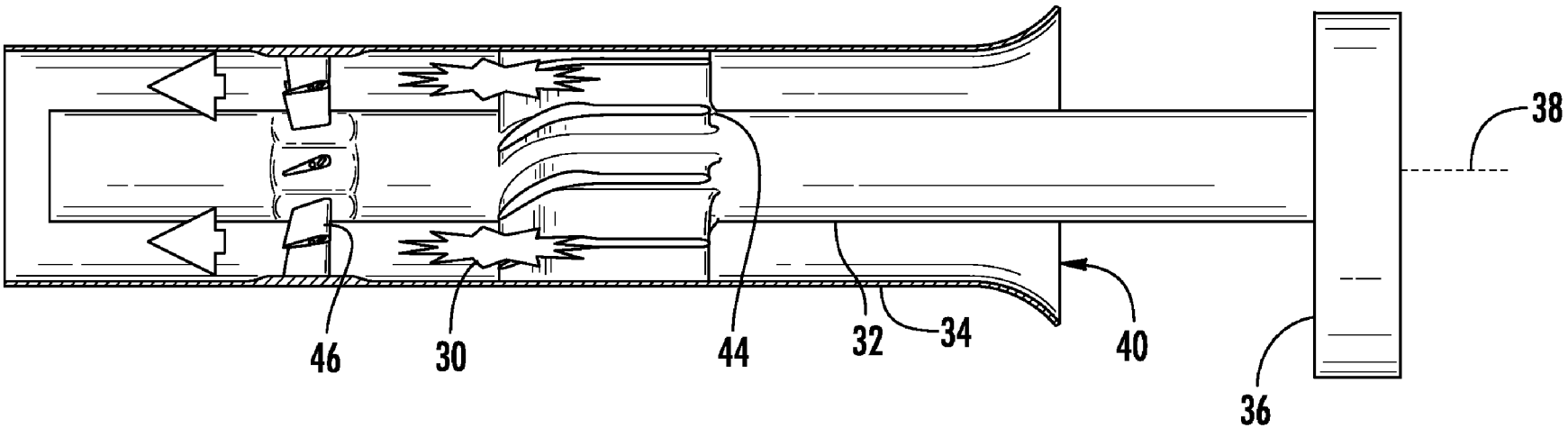
FIG. 10 is a side perspective view of the nozzle shown in FIG. 3 responding to a flame holding event.

FIG. 10 provides a side perspective view of the nozzle 14 shown in FIG. 3 responding to a flame holding event. As shown, the combustion flame 30 inside the nozzle 14 increases the temperature proximate to the guides 46. Specifically, the combustion flame 30 increases the temperature of the center body 32, causing the center body 32 to expand more than the underlying plate 48 and rotate or pivot the guides 46 with respect to the center body 32 as previously described with respect to either FIG. 8 or 9. As the guides 46 become more aligned with the axial centerline 38 of the nozzle 14, the guides 46 reduce the swirl and/or the tangential velocity of the fuel-working fluid mixture flowing through the passage 40. Alternately, or in addition, the guides 46 increase the axial velocity and/or mass flow rate of the working fluid flowing through the passage 40. Since the swirl angle induced by the swirler vanes 44 will remain approximately the same upstream of the guides 46 and the mass flow increases, the combined velocity magnitude (axial and tangential) of the working fluid increases. Assuming a constant fuel flow, the fuel-to-working-fluid ratio thus decreases. It is believed that any or all of these effects contribute to blowing the combustion flame 30 out of the nozzle 14 and back into the combustion chamber 22. When the flame holding no longer exists inside the nozzle 14, the temperature of the center body 32 decreases, causing the guides 46 to rotate or pivot with respect to the center body 32 and therefore again becoming aligned with the swirling fuel and working fluid mixture.

Figure 11:
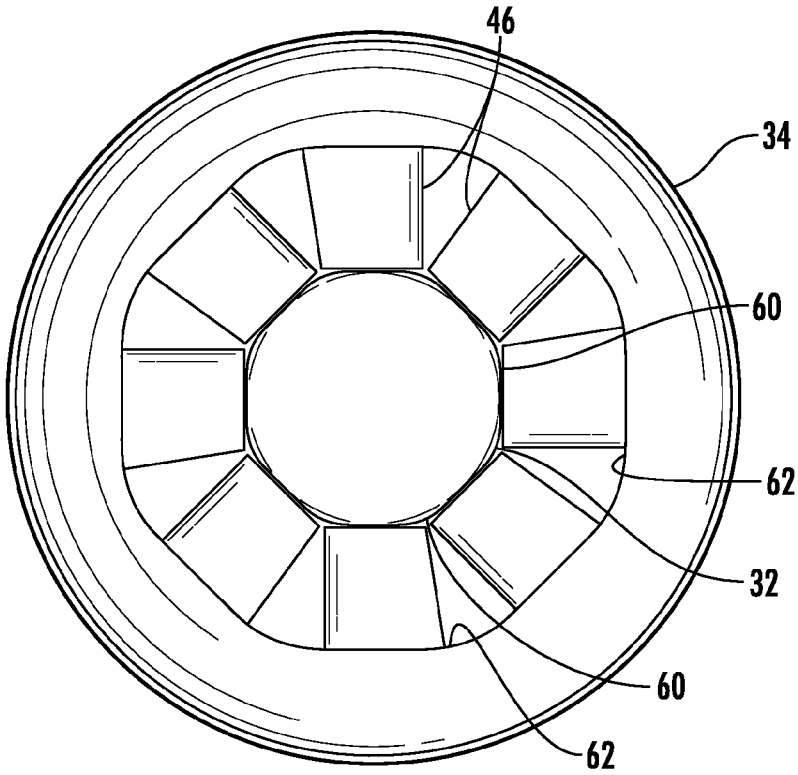
FIG. 11 is an upstream axial view of the nozzle shown in FIG. 3 during normal operations.
Figure 12:
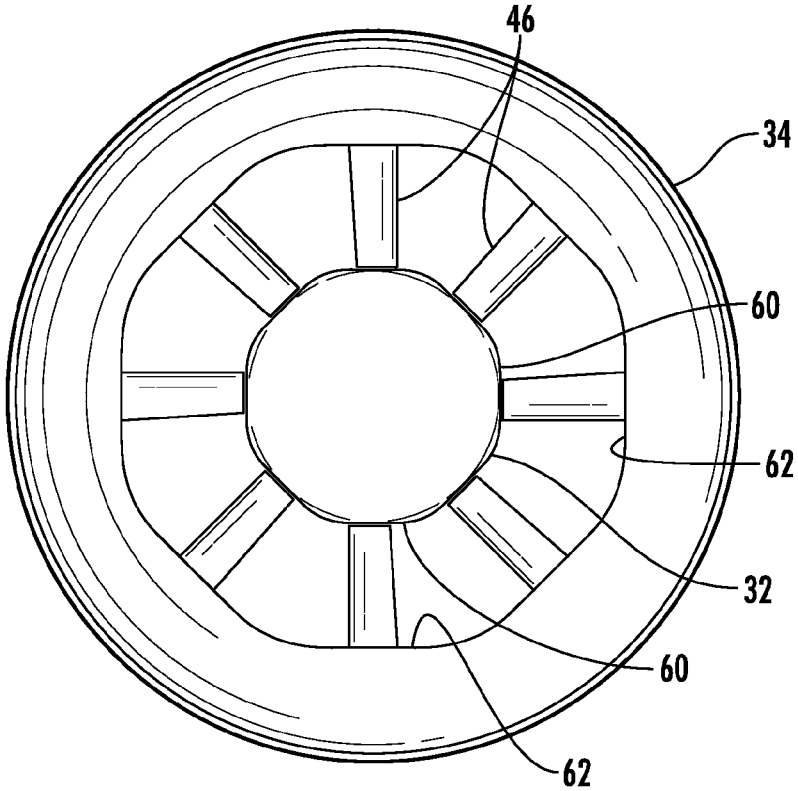
FIG. 12 is an upstream axial view of the nozzle shown in FIG. 10 responding to a flame holding event.

FIG. 11 provides an upstream axial view of the nozzle shown in FIG. 3 during normal operations, and FIG. 12 provides an upstream axial view of the nozzle shown in FIG. 10 responding to a flame holding event. As shown in each figure, the center body 32 and/or shroud 34 are substantially flat proximate to each guide 46. Specifically, the center body 32 includes a substantially flat portion 60 proximate to each guide 46, as previously described with respect to FIGS. 5 and 6. Similarly, the shroud 34 includes a substantially flat portion 62 proximate to each guide 46. The substantially flat portions 60, 62 allow each guide 46 to rotate or pivot with respect to the center body 32 and/or shroud 34 without binding or creating an excessive gap between the center body 32 and the guides 46 or between the guides 46 and the shroud 34 which might create an attachment point for the combustion flame 30.

The nozzle 14 described and illustrated with respect to FIGS. 2-12 may provide a method for supplying fuel to the combustor 10. The method may include flowing fuel and a working fluid through the nozzle 14 at a predetermined mass flow rate and sensing a flame holding event inside the nozzle 14. For example, an increase in the temperature in the passage 40 or proximate to the guides 46, swirler vanes 44, and/or center body 32 may provide a reliable indication of the presence of a flame holding event inside the nozzle 14. The method may further include pivoting one or more guides 46 inside the nozzle 14 to increase the mass flow rate of the working fluid flowing through the nozzle 14. In particular embodiments, the method may further include swirling the working fluid and fuel upstream of the one or more guides 46 and/or decreasing a tangential velocity of the fuel and working fluid flowing through the nozzle 14 in response to the flame holding event.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor fuel nozzle, comprising:

a. a center body of the combustor fuel nozzle;

b. a shroud circumferentially surrounding at least a portion of the center body to define a passage between the center body and the shroud; and c. a pivotable guide between the center body and the shroud, wherein the pivotable guide configured to pivot with respect to the center body in response to a sensing of flame holding occurring inside the combustor fuel nozzle to control a fluid flow.

2. The combustor nozzle as in claim 1, wherein the center body is substantially flat proximate to the pivotable guide.

3. The combustor nozzle as in claim 1, wherein the shroud is substantially flat proximate to the pivotable guide.

4. The combustor nozzle as in claim 1, further comprising a plate extending inside at least a portion of the center body.

5. The combustor nozzle as in claim 4, further comprising a pivotal connection between the pivotable guide and at least one of the plate or the center body.

6. The combustor nozzle as in claim 4, further comprising a sliding connection between the pivotable guide and at least one of the plate or the center body.

7. The combustor nozzle as in claim 1, wherein the pivotable guide is aligned at an acute angle to a longitudinal axis of the center body.

8. The combustor nozzle as in claim 1, further comprising a swirler vane upstream of the pivotable guide.

9. A combustor fuel nozzle, comprising:

a. a center body of the combustor fuel nozzle, wherein the center body has a thermal coefficient of expansion;

b. a plate extending inside at least a portion of the center body; and c. a pivotable guide connected to the center body and the plate so that the pivotable guide configured to pivot with respect to the center body in response to sensing of a flame holding occurring inside of the combustor fuel nozzle to control a fluid flow.

10. The combustor nozzle as in claim 9, wherein the center body is substantially flat proximate to the guide.

11. The combustor nozzle as in claim 9, wherein the plate has a thermal coefficient of expansion that is less than the thermal coefficient of expansion of the center body.

12. The combustor nozzle as in claim 9, further comprising a shroud circumferentially surrounding at least a portion of the center body to define a passage between the center body and the shroud, wherein the shroud is substantially flat proximate to the pivotable guide.

13. The combustor nozzle as in claim 9, further comprising a pivotal connection between the pivotable guide and at least one of the plate or the center body.

14. The combustor nozzle as in claim 9, further comprising a sliding connection between the pivotable guide and at least one of the plate or the center body.

15. The combustor nozzle as in claim 9, wherein the guide is aligned at an acute angle to a longitudinal axis of the center body.

16. The combustor nozzle as in claim 9, further comprising a swirler vane upstream of the pivotable guide.

17. A method for supplying fuel to a combustor, comprising:

a. flowing a working fluid through a fuel nozzle of the combustor at a mass flow rate;

b. flowing a fuel through the fuel nozzle;

c. sensing a flame holding occurring inside the fuel nozzle; and d. pivoting a guide inside the fuel nozzle to increase the mass flow rate of the working fluid flowing through the fuel nozzle in response to the sensing of the flame holding.

18. The method as in claim 17, further comprising swirling the working fluid and fuel upstream of the guide.

19. The method as in claim 17, further comprising decreasing a tangential velocity of the fuel and working fluid flowing through the fuel nozzle.

20. The method as in claim 17, further comprising increasing an axial velocity of the fuel and working fluid flowing through the fuel nozzle.

* * * * *